US008844917B2

(12) United States Patent
Buske

(10) Patent No.: US 8,844,917 B2
(45) Date of Patent: Sep. 30, 2014

(54) APPARATUS AND METHOD OF JOINING HULL PLATES

(75) Inventor: Thomas Buske, Menominee, MI (US)

(73) Assignee: Marinette Marine Corporation, Marinette, WI (US)

( * ) Notice: Subject to any disclaimer, the term of this patent is extended or adjusted under 35 U.S.C. 154(b) by 22 days.

(21) Appl. No.: 13/542,023

(22) Filed: Jul. 5, 2012

(65) Prior Publication Data

US 2014/0007401 A1 Jan. 9, 2014

(51) Int. Cl.
*B25B 5/00* (2006.01)

(52) U.S. Cl.
USPC ..... 269/143; 269/95

(58) Field of Classification Search
USPC ..... 269/143, 249, 166–171, 95, 32, 228
See application file for complete search history.

(56) References Cited

U.S. PATENT DOCUMENTS

| | | | | |
|---|---|---|---|---|
| 1,821,163 | A * | 9/1931 | King | 269/249 |
| 4,607,829 | A * | 8/1986 | Suska | 269/88 |
| 4,828,241 | A * | 5/1989 | Yang | 269/114 |
| 5,513,838 | A * | 5/1996 | Van Rossum | 269/203 |
| 7,909,314 | B2 * | 3/2011 | Roesch et al. | 269/6 |
| 8,047,494 | B2 * | 11/2011 | Chang | 248/316.1 |
| 2007/0296229 | A1 * | 12/2007 | Chauvin et al. | 294/81.61 |
| 2008/0036229 | A1 * | 2/2008 | Oliason | 294/106 |

* cited by examiner

*Primary Examiner* — Lee D Wilson
(74) *Attorney, Agent, or Firm* — Harness, Dickey & Pierce, P.L.C.

(57) ABSTRACT

An apparatus and method of using the apparatus to join hull plates of a ship's hull includes forming a flat plate to match three-dimensional contours of a ship or boat hull. The apparatus including a pair of angularly adjustable arms attached at a pivot point, an angle adjusting mechanism to adjust an angle between the arms, an anchoring member on distal ends of each of the arms to secure the applicator bar in a fixed position relative to the boat member, and a plurality of extendable pressing members attached along a length of the arms to engage the structural plate.

11 Claims, 10 Drawing Sheets

APPARATUS AND METHOD OF JOINING HULL PLATES

FIELD

The present invention relates to an apparatus and method for joining hull plates of a ship's hull, and more particularly to forming a flat plate to match the three-dimensional contours of a ship or boat hull.

BACKGROUND

Ship and boat building materials traditionally include one or more of wood, steel, fiberglass, various composites and aluminum materials. While each of these materials has advantages and disadvantages, the choice of ship and boat building materials may rely on the particular use and application of the vessel. The choice of these materials has advantages and drawbacks. For example, wood requires high maintenance while steel boats may be heavy and expensive. Many modern boats are therefore made of fiberglass reinforced plastic. An advantage of fiberglass is that the material is inexpensive and easily formed. However, such composites also have drawbacks such as being highly flammable, a tendency to absorb water and delaminate, as well as being more easily deformed than other building materials.

In light of the disadvantages of other building materials, marine grade aluminum is often the choice material due to superior resistance to leaks, water absorption, delamination, and deformation. Further, the ease of workability, welding and handling make aluminum hulled ships and boats an economical choice.

SUMMARY

According to an example embodiment of the apparatus and method described herein, a new and unique applicator bar is provided that improves efficiency in ship and boat building, as well as improves the safety of workers in ship and boat building.

In an embodiment, the apparatus is an applicator bar for applying a structural plate to a boat member. The applicator bar may include, for example, a pair of angularly adjustable arms attached at a pivot point, an angle adjusting mechanism to adjust an angle between the arms, an anchoring member on distal ends of each of the arms to secure the applicator bar in a fixed position relative to the boat member, and a plurality of extendable pressing members attached along a length of the arms to engage the structural plate.

In an embodiment, the applicator bar may further include a locking pin and a plurality of respective aligning holes in adjacent ends of each arm. The locking pin is insertable into and removable from the plurality of respective aligning holes to adjust an angle formed between the arms.

In an embodiment, the applicator bar may include a screw drive that has a first lug secured to a first arm and a second lug secured to a second arm. A drive motor is connected to the first lug and a threaded rod extends between the drive motor and the second lug. The rod may be operatively connected to the drive motor and be threaded into the second lug to rotate the arms about the pivot point.

In an embodiment, the applicator bar may include a drive ram connected to each of the arms. The drive ram has a ram cylinder attached to a first arm via a ram lug and a shaft that moves in and out of the ram cylinder and is attached to a second arm.

In an embodiment, the applicator bar may also include a roller at distal ends of each of the arms. The plurality of extendable pressing members may be operatively connected to a pump to extend the pressing members. The plurality of extendable pressing members may be hydraulic ram cylinders attached along a length of each of the arms to engage the structural plate. The applicator bar may also further include a lifting member extending from an uppermost point of the applicator bar.

In an embodiment, the applicator bar may be used to apply a structural plate to a boat member using the pair of angularly adjustable arms attached at a pivot point of the applicator bar. The method may include, for example, providing a structural plate on one or more transverse frame members of a boat, positioning the applicator bar over the structural plate at a position of a frame member, lowering the applicator bar to engage with the structural plate, adjusting an angle formed between the arms by rotating the arms about the pivot point, securing the applicator bar in a fixed position relative to the transverse frame member, applying a pressing force between the applicator bar and the structural plate such that the structural plate conforms to a shape of the transverse frame member and attaching the structural plate to the transverse frame member.

Adjusting the angle formed between the arms may include removing a locking pin from a first set of aligned holes in the arms corresponding to a first respective angle between the arms, lifting the applicator bar to rotate the arms about the pivot point such that a second set of holes in the arms corresponding to a desired second respective angle between the arms are aligned and placing the locking pin in the second set of holes.

In an embodiment, adjusting the angle formed between the arms may include actuating a drive motor connected to the applicator bar to turn a threaded rod interconnected between the arms to rotate the arms about the pivot point to a desired angle.

In an embodiment, adjusting the angle formed between the arms may include activating a drive ram connected to the applicator bar to actuate a ram shaft interconnected between the arms to rotate the arms about the pivot point to a desired angle.

Securing the applicator bar may include attaching a connecting device between an anchor point that is remote from the applicator bar to opposite ends the arms. Applying a pressing force between the applicator bar and the structural plate may include actuating a plurality of hydraulic rams attached long a length of each of the arms via a pump to extend the rams to engage a surface of the structural plate.

BRIEF DESCRIPTION OF THE DRAWINGS

The present invention will become more fully understood from the detailed description given below and the accompanying drawings, which are provided for purposes of illustration only and thus, do not limit the invention. In the drawings which illustrate the best mode presently contemplated for carrying out the present invention.

Figure 1:
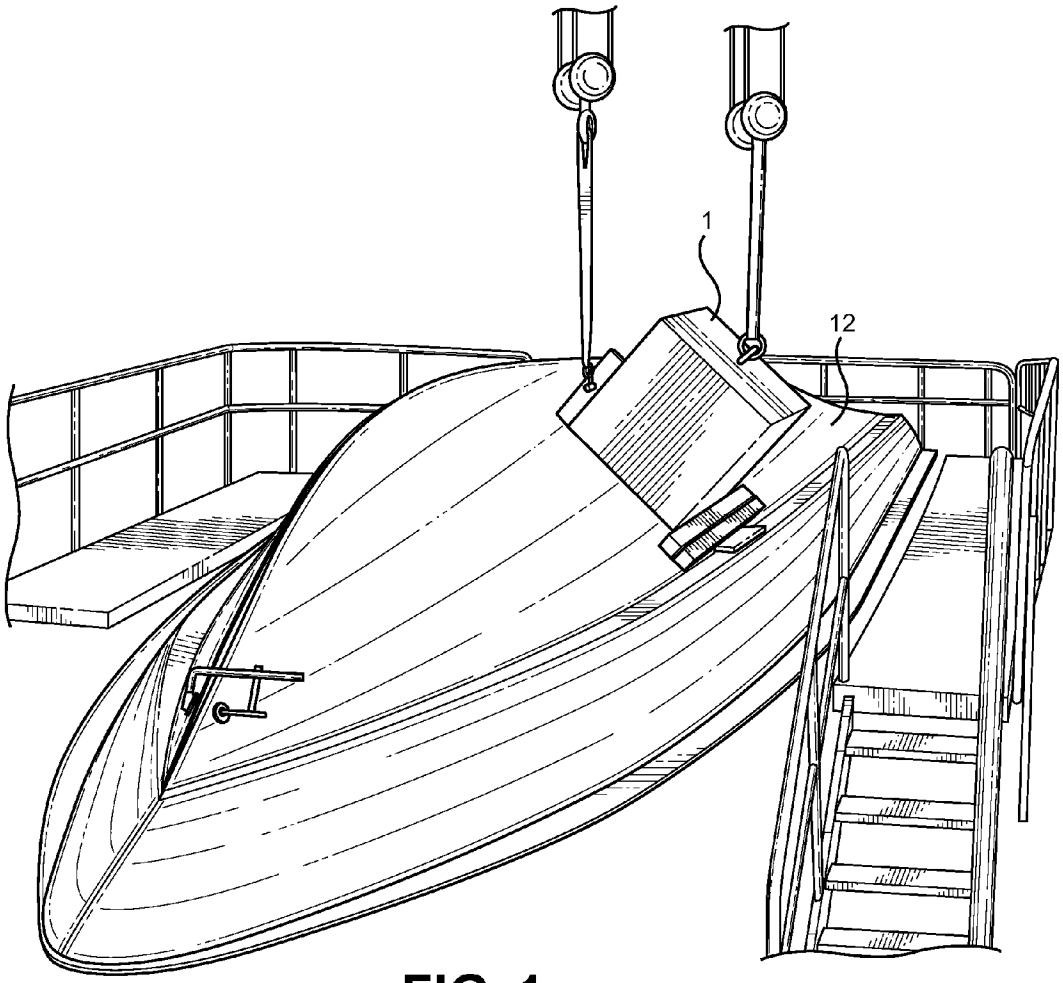
FIG. 1 shows a conventional method of bending a hull plate to conform to a desired shape.

These drawings have been provided to assist in understanding exemplary embodiments of the invention as described in more detail below and should not be construed as limiting the invention. In particular, the relative spacing, positioning, sizing and dimensions of the various elements illustrated in the drawings may not be drawn to scale and may have been exaggerated, reduced or otherwise modified for the purpose of improved clarity.

Those of ordinary skill in the art will also appreciate that a range of alternative configurations may have been omitted simply to improve the clarity and reduce the number of drawings. Those of ordinary skill will appreciate that certain of the various structural aspects of the invention and/or process steps illustrated or described with respect to the exemplary embodiments may be selectively and independently combined to create other structures and/or methods of use useful related to a reconfigurable stand fan without departing from the scope and spirit of this disclosure.

DETAILED DESCRIPTION OF EXAMPLE EMBODIMENTS

Manufacturing boats and ships of aluminum requires applying aluminum plates, such as hull plates to a series of structural frame members or ribs. The application of such plates to the ribs requires bending and forming the plates to the particular shape and dimensions needed for a particular boat or ship design. While aluminum is more easily formed than steel, for example, the process of doing so is known to be time consuming, cumbersome and often dangerous. For example, as shown in FIG. 1, a known process of forming an aluminum plate to a hull involved placing a weight 1 of appropriate size on to the plate 12 to bend the plate 12 against a rib of the boat or ship and then tacking or welding the plate to the rib. The weight 1 is then lifted, for example by an overhead crane, and placed over another rib whereby the process is repeated over the length of the boat. The process is slow and does not allow for uniform loading of both the port and starboard shell plates which may reduce the build quality and the resulting product. The process is also dangerous as workers are required to work in close proximity to the weight during its repeated movement and placement.

Figure 2:
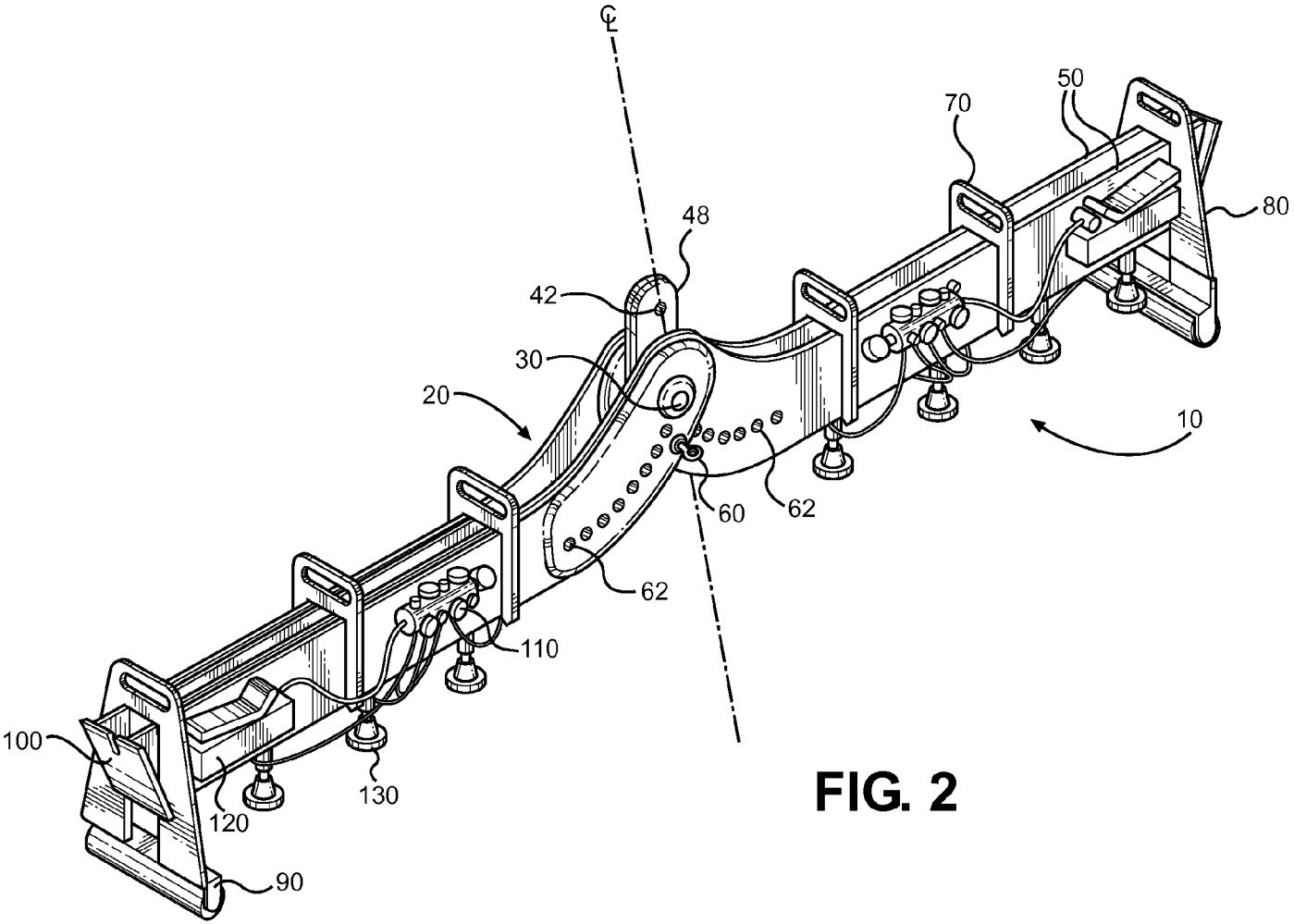
FIG. 2 shows an example embodiment of an applicator bar according to the present invention.
Figure 3:
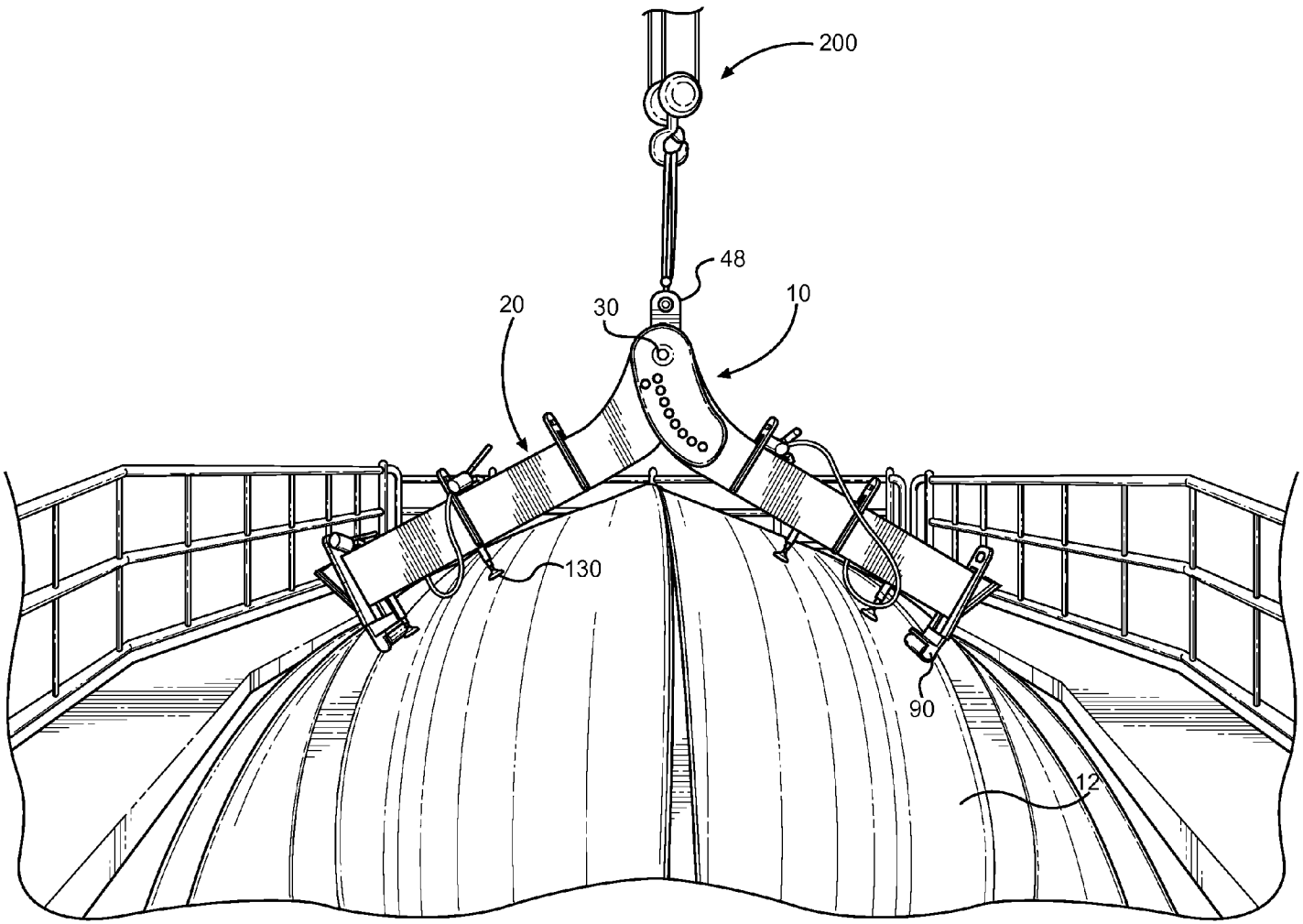
FIG. 3 shows an example embodiment of the applicator bar of FIG. 2 in use.

To improve the safety, process and efficiency of forming a flat plate to match the three dimensional contours of a boat hull, the present applicator bar device was developed. In an example embodiment, as shown in FIGS. 2 and 3, the applicator bar 10 applies a force perpendicular to the plane of the shell plates 12 and outboard edge of the boat's structural frame members 14 (FIG. 4) inboard of the shell plate 12 (FIG. 3). In the example embodiment, the applicator bar 10 includes a hinged joint at the centerline C to allow the plane of the applicator bar 10 to be substantially parallel to the changing plane of the hull form at each transverse hull frame member 14. The applicator bar 10 also applies a force in multiple locations via rams 130 along the frame line to "walk" the plate 12 into the proper shape (typically started from the centerline of the hull working outboard to the chine). The force applied perpendicular to the hull shape, is regulated so as to not overload and damage the structural hull framing inboard of the shell plate.

Figure 4:
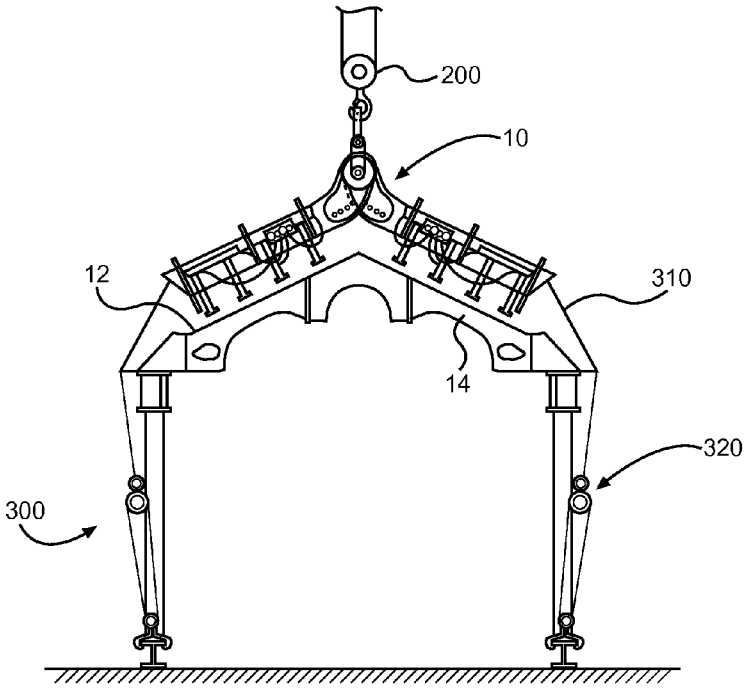
FIG. 4 shows a cross sectional view of an example embodiment of the applicator bar of FIG. 2, boat hull and construction jig.

As shown in FIGS. 2-4, the applicator bar 10 is connected to an overhead crane 200 and positioned over a transverse frame member (rib) 14. The applicator bar 10 is lowered to the shell plate 12 until the rollers 90 make contact with the shell plate 12. A position locking pin 60 is then removed and the overhead crane lifts the bar until the holes of the port and starboard arms 20 align at an appropriate set of holes 62 in the arms 20 which correspond to an appropriate/desired angle of the arms 20 relative to the hull plate 12. The locking pin 60 is then replaced and outboard ends of the bar 10 are secured to a construction jig 300, such as at a base beam, using chains 310 and chain hoists 320, for example (FIG. 4).

In an example embodiment, ram cylinders 130 on each arm 20 are activated to apply a force perpendicular to respective shell plates 12 on either side of the centerline of the hull thereby pushing/pressing the shell plates 12 tightly against the hull frame member 14. The ram cylinders 130 may be hydraulic or pneumatic ram cylinders. In an example embodiment, one or more bags or bladders filled with air, water or any other gas, fluid or material may be used in place of the ram cylinders 130 to produce a pressure between the applicator bar 10 and a shell plate 12.

The frame member 14 and shell plate 12 are then tack welded together, the pressure on the on the ram cylinders 130 is released, and the chains 310 to the construction jig 300 are unhooked thereby freeing the applicator bar 10 from a fixed position. The applicator bar 10 is then repositioned using the overhead crane 200 over another transverse frame member 14 and the process is repeated until each hull frame member 14 has been tack welded to the shell plate 12.

As used herein, hydraulics may include many different types of fluids including but not limited to gases, water, mineral oil, water base fluids, petroleum base, synthetic base fluids or any other combination or variations. Pressure applied to a fluid (including a gas) may be implemented by any known means including but not limited to a hand pump, electrical driven pump, air operated pump, air over hydraulic fluids or any other variations or combinations. The ram cylinders 130 may be single or double acting cylinders or rams with any manufacture options. Limit switches and or pressure switches may also be associated with the applicator bar to limit a force applied by the ram cylinders 130 and distance of travel of the ram cylinders 130. The switches may be, but are not limited to, electrical, pneumatic or a combination actuators such as electrically powered, pneumatically powered, hydraulically powered, hand powered, and the like, or any combination thereof.

As shown in the example embodiment of FIG. 2, the applicator bar 10 includes a pair of arms 20 pivotally hinged to one another via a hinge pin/joint 30. The hinge pin forms a pivot point about which the arms 20 may rotate. A lifting lug 40 placed at the pivot point receives the hinge pin and includes a lift point 42 at which the applicator bar 10 may be lifted for proper placement on a shell plate 12. In an embodiment, each arm 20 has parallel spaced apart side wall members 50 between which the lifting lug 40 is disposed.

As further shown in FIG. 2, the side walls 50 of the arms 20 may intersect or overlap one another at respective adjacent first ends of the arms. The overlapping portions of the arms 20 may include a series of through holes (aligning holes) 62 which receive a position locking pin 60 when the respective holes 62 are properly aligned thereby adjusting an angular position of the arms 20 relative to a shell plate 12 disposed on a hull frame member 14.

In an embodiment, the side walls 50 of the arms 20 are maintained in respective parallel position relative to one another by one or more stiffeners 70, 80 configured to maintain a spacing and alignment of the side walls 50. In an example embodiment, one or more mid-stiffeners 70 may be placed between overlapping portions of the arms 20 and respective distal ends of the arms 20. End stiffeners 80 may be placed at respective distal ends of the arms 20. In an embodiment, the spacers may have a substantially "U-shape" and be placed on exterior side surfaces of the walls 50. By maintaining a proper spacing and alignment of the side walls 50, arm strength and rigidity is improved and an area is provided in which additional components of the applicator bar may be placed. These components and their functions will be discussed in detail below.

In an embodiment, the end stiffener 80 may include a roller 90 which, when the applicator bar 10 is in use is in contact with the shell plate 12. The rollers 90 allow the applicator bar 10 to roll along a surface of the shell plate 12 thereby conforming to the angle of the shell plate as the shell plate is formed to the curvature of a respective hull frame member (discussed in more detail below).

An end plate 100 may be placed at respective distal ends of the arms 20 connecting the side walls 50. As discussed in more detail below, end plates 100 may be used as an attachment or anchor point to secure the applicator bar 10 to a point on a construction jig 300 (or other fixed anchoring point). In an example embodiment, chains 310 and chain hoists 320, cables, etc., may be attached to the end plates 100 and the construction jig 300 to secure the applicator bar 10 in place. In an example embodiment, the end plates 100 may include a notched portion which provides an attachment point for a chain hook or the like.

The applicator bar 10 may also include a manifold 110 operatively connected to a pump 120. A plurality of rams 130 are fixed to the arms 20 and operatively connected to the manifold 110. In an example embodiment, the rams may be hydraulically or pneumatically operable. In operation, the pump 120 delivers a fluid to the rams 130 via the manifold 110 such that the rams 130 contact the shell plate 12 and form the shell plate to the hull frame member 14 by pressure. In an example embodiment, the pump 120 and manifold 110 may be placed within a space between the side walls 50 of the arms or be attached to an outer surface of the sidewall 50 as shown in FIG. 2, for example. However, the example embodiment shown in FIG. 2 is not limited to such a configuration. For example, the pump and/or manifold could be remote from the applicator bar 10 and still be operatively connected to the rams 130.

In operation, the applicator bar 10 applies a force perpendicular to the plane of the shell plates 12 and an outboard edge of the structural transverse frame members 14 inboard of the shell plate 12. The applicator bar 10 includes a hinged joint 30 at the centerline C of the applicator bar to allow the plane of the applicator bar 10 to be parallel to the changing plane of the hull form at each transverse frame member 14. The applicator bar 10 also may apply a force in multiple locations via the rams 130 along hull frame member to "walk" the plate 12 into the proper shape (typically started from the centerline of the hull working outboard to the chine) conforming to the respective hull frame member 14. The force applied perpendicular to the hull shape, is regulated via the pump 120 and manifold 110 so as to not overload and damage the structural hull framing inboard of the shell plate. In an embodiment, limit switches (not shown) may also be used to regulate the force applied to the hull shape.

In an example embodiment, an angle between the arms 20 of the applicator bar 10 may be controlled and adjusted by a screw drive 400, such as electric screw drive, to adjust an angle of the arms 20 relative to one another and relative to one or more shell plates 12. As shown for example in FIG. 5, the applicator bar 10 may include a pair of opposed arms 20 pivotally hinged to one another via a hinge pin 30. The hinge pin forms a pivot point about which the arms 20 may rotate thereby changing a relative angle between the two arms 20. A lifting lug 40 placed at the pivot point is connected to the hinge pin 30 via a pair of opposed lug arms 41. The lifting lug 40 includes a lift point 42 at which the applicator bar 10 may be lifted by, for example, an overhead crane, for proper placement on a shell plate. Each arm 20 has parallel spaced apart side wall members 50 between which the lifting lug 40 is disposed.

Figure 5:
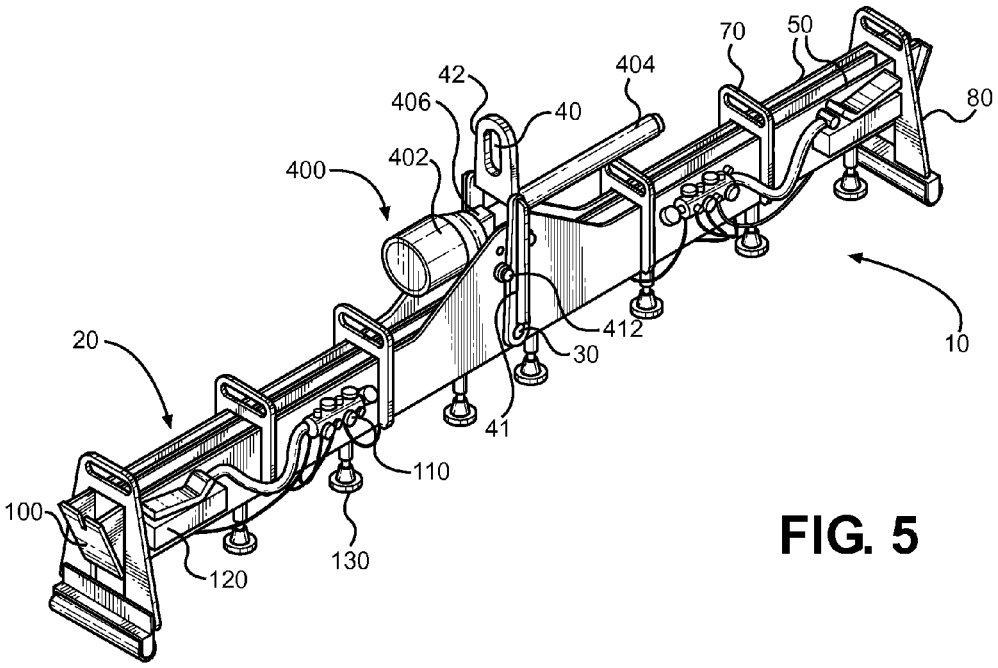
FIG. 5 shows an example embodiment of applicator bar with a screw drive.
Figure 6:
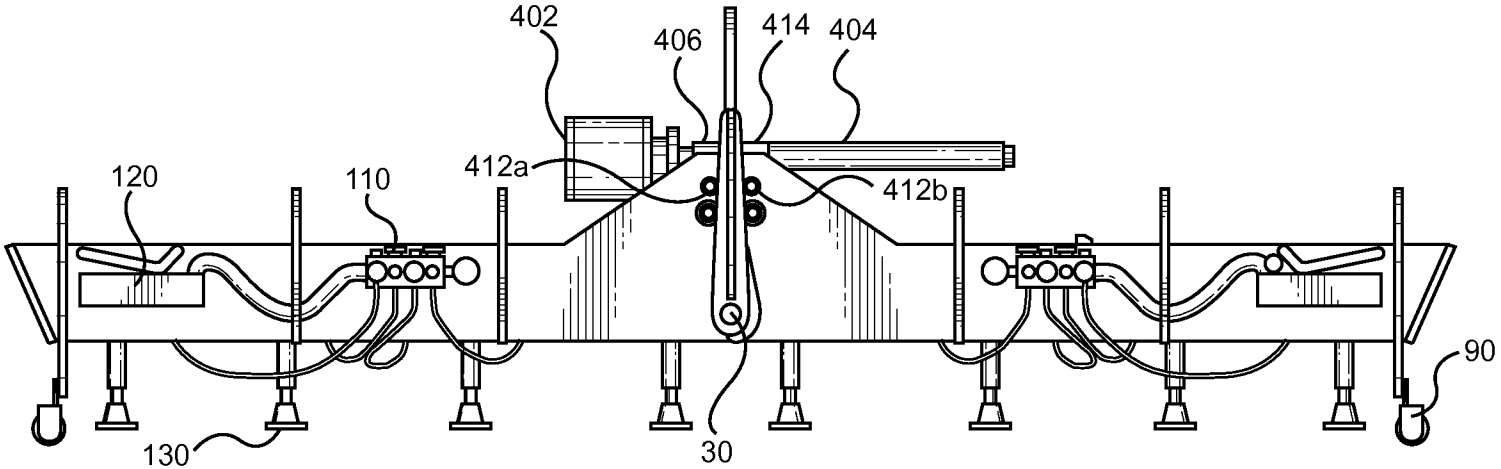
FIG. 6 shows a front view of the applicator bar of FIG. 5.
Figure 7:
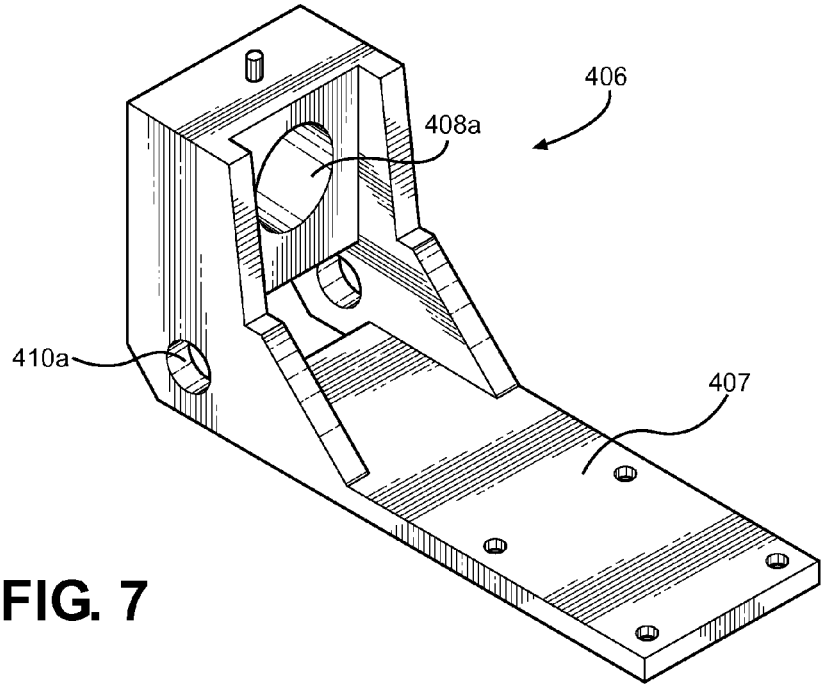
FIG. 7 shows an example motor lug of the applicator bar.

As shown in FIGS. 5 and 6, the applicator bar 10 includes an electric screw drive 400. The screw drive 400 includes a drive motor 402 and a threaded rod 404 that is rotated upon activation of the drive motor 402. In the embodiment, a motor lug 406 (FIG. 7) receives the motor 402 on a flange portion 407 of the lug 406. The lug 406 includes a threaded hole 408*a* through which the rod 404 is inserted. The motor lug 406 also includes attachment holes 410*a* which allows the motor lug 406 to be attached to an arm 20. In the present example, the motor lug 406 is attached to the arm 20 by bolts 412*a*.

Figure 8:
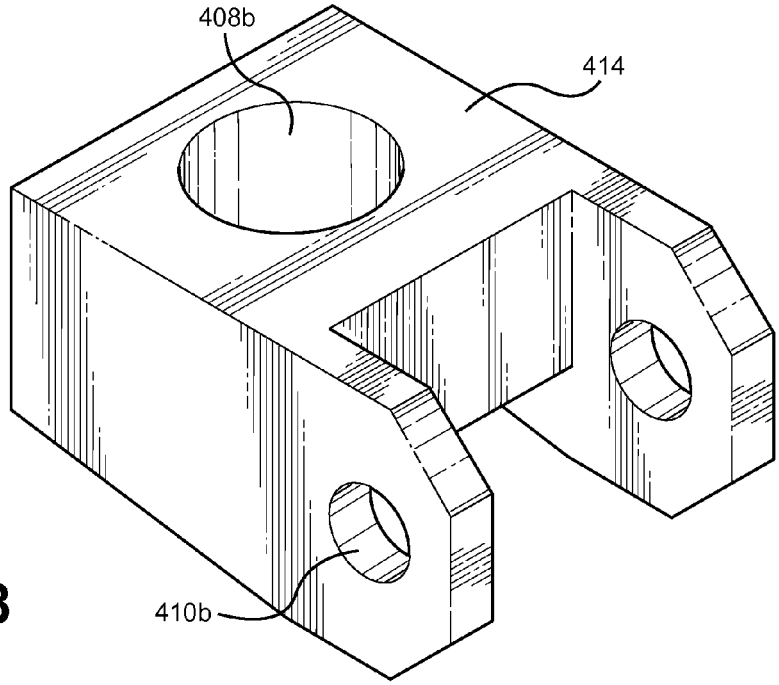
FIG. 8 shows an example receiving lug of the applicator bar.

A receiving lug 414 (FIG. 8) also includes a threaded hole 408*b* through which the rod 404 is inserted. The receiving lug 414 also includes attachment holes 410*b* which allows the receiving lug 414 to be attached to an arm 20. In the present example, the receiving lug 414 is attached to the arm 20 by bolts 412*b*. Upon actuation of the motor 402, the rod 404 is rotated which, due to the attachment of the lugs 406, 414 to different arms, will increase or decrease a spacing as the rod 404 is rotated and threads between the lugs 406, 414 causing the arms to pivot about the hinge pin 30 and changing an angle between the arms 20.

The side walls 50 of the arms 20 are maintained in respective parallel position relative to one another by one or more stiffeners 70, 80 configured to maintain a spacing and alignment of the side walls 50. In an example embodiment, one or more mid-stiffeners 70 may be placed between overlapping portion of the arms 20 and respective distal ends of the arms 20. End stiffeners 80 may be placed at respective distal ends of the arms 20. In an embodiment, the spacers may have a substantially "U-shape" and be placed on exterior side surfaces of the walls 50. By maintaining a proper spacing and alignment of the side walls 50, arm strength and rigidity is improved and an area is provided in which additional components of the applicator bar may be placed. These components and their functions will be discussed in detail below.

In an embodiment, the end stiffener 80 may include a roller 90 which, when the applicator bar 10 is in use contacts the shell plate 12. The rollers 90 allow the applicator bar 10 to roll along the surface of the shell plate 12 thereby conforming to the angle of the shell plate 12 as the shell plate is formed to the curvature of a respective hull frame member 14 (discussed in more detail below).

An end plate 100 may be placed at respective distal ends of the arms 20 connecting the side walls 50. As discussed in more detail below, end plates 100 may be used as an attachment or anchor point to secure the applicator bar 10 to an attachment point on the construction jig 300 (or other fixed anchoring point). In an example embodiment, chains 310 and chain hoists 320, cables, etc., may be attached to the end plates 100 and the construction jig 300 to secure the applicator bar 10 in place. In an example embodiment, the end plates 100 may include a notched portion at which a chain hook or other attachment device may be attached.

The applicator bar 10 may also include a manifold 110 operatively connected to a pump 120. A plurality of rams 130 are fixed to the arms 20 and operatively connected to the manifold 110. In an example embodiment, the rams 130 may be hydraulically or pneumatically operable. In operation, the pump 120 delivers a fluid to the rams 130 via the manifold 110 such that the rams 130 contact the shell plate 12 and form the shell plate to the hull frame member 14 by pressure. In an example embodiment, the pump 120 and manifold 110 may be placed within the space between the side walls 50 of the arms or attached to an outer surface of the sidewall 50 as shown in FIGS. 5 and 6. However, the example embodiment shown in FIGS. 5 and 6 is not limited to such a configuration. For example, the pump and/or manifold could be remote from the applicator bar 10 and still be operatively connected to the rams 130.

In operation, the applicator bar 10 applies a force perpendicular to the plane of the shell plates 12 and outboard edge of the structural transverse frame members 14 inboard of the shell plate 12. The applicator bar 10 includes a hinged joint 30 at the centerline C to allow the plane of the applicator bar 10 to be parallel to the changing plane of the hull form at each transverse frame member 14. The applicator bar 10 also applies a force in multiple locations via the rams 130 along hull frame member to "walk" the plate 12 into the proper shape (typically started from the centerline of the hull working outboard to the chine) conforming to the respective hull frame member 14. The force applied perpendicular to the hull shape, is regulated via the pump 120 and manifold 110 so as to not overload and damage the structural hull framing inboard of the shell plate. In an embodiment, limit switches (not shown) may also be used to regulate the force applied to the hull.

Figure 9:
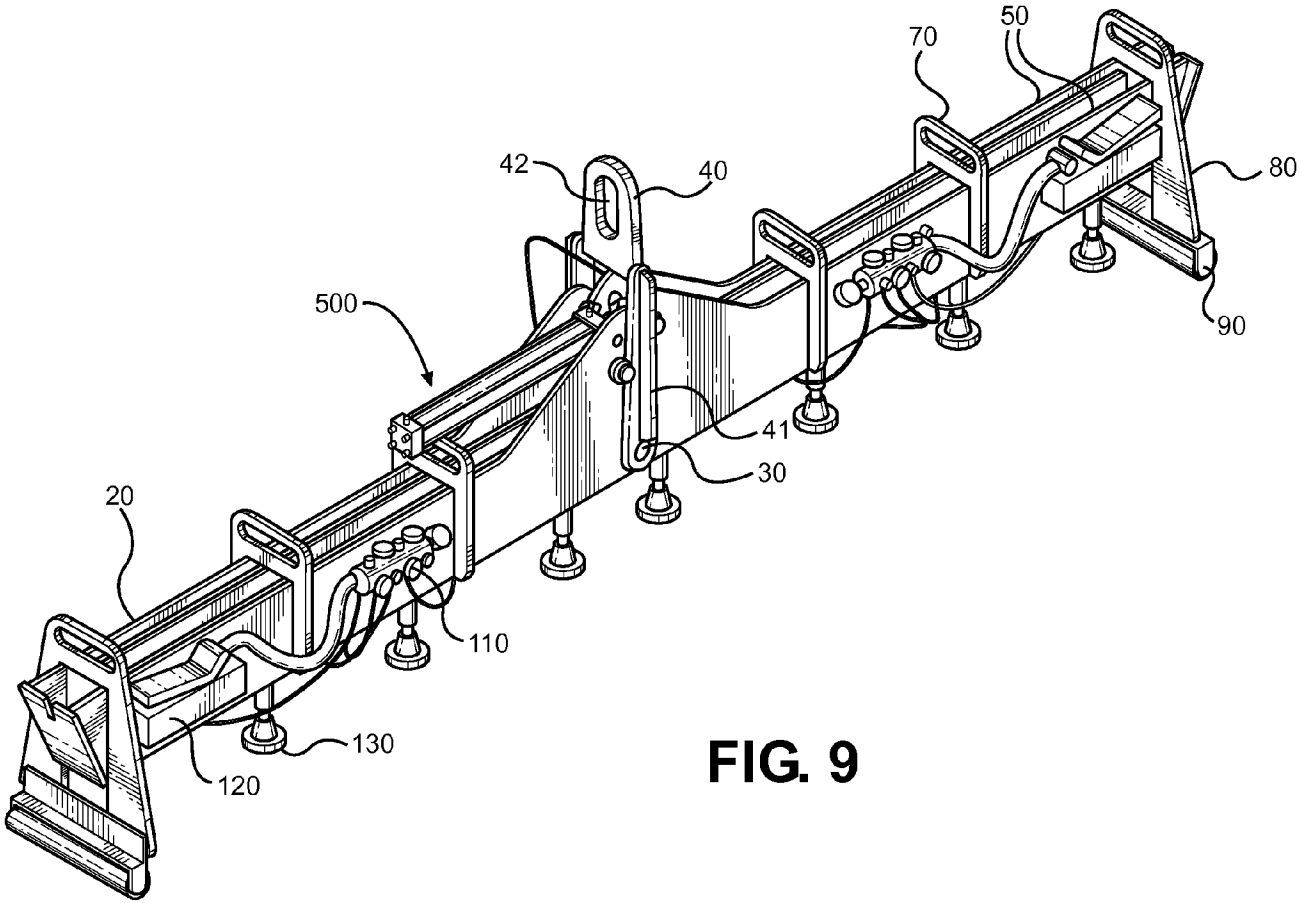
FIG. 9 shows an example embodiment of an applicator bar with a hydraulically actuated drive.

In an example embodiment, the applicator bar 10 may also be hydraulically or pneumatically actuated adjust the angle of the arms 20 relative to one another and relative to one or more shell plates 12. As shown in FIG. 9, the applicator bar 10 may include a pair of opposed arms 20 pivotally hinged to one another via a hinge pin 30. The hinge pin 30 forms a pivot point about which the arms 20 may rotate thereby changing a relative angle between the two arms 20. A lifting lug 40 placed at the pivot point is connected to the hinge pin 30 via a pair of opposed lug arms 41. The lifting lug 40 includes a lift point 42 at which the applicator bar 10 may be lifted by, for example, an overhead crane 200, for proper placement on a shell plate 12. Each arm 20 has parallel spaced apart side wall members 50 between which the lifting lug 40 is disposed.

Figure 10:
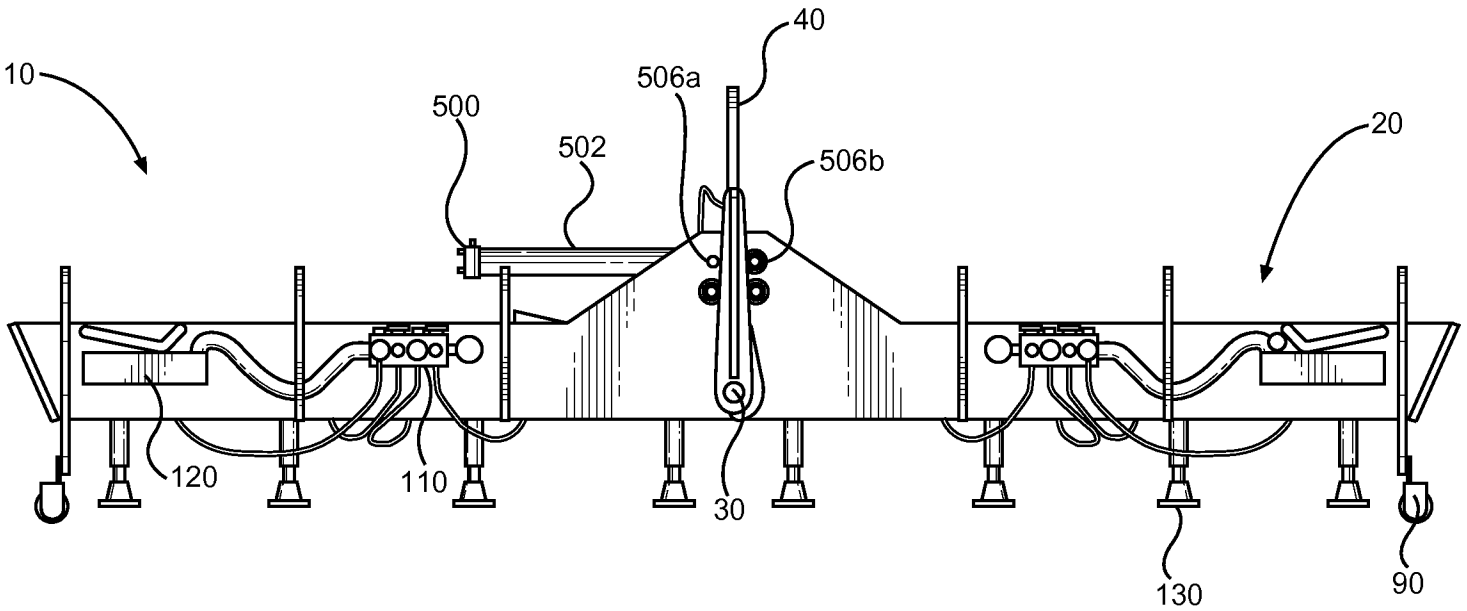
FIG. 10 shows a front view of the applicator bar of FIG. 9.
Figure 11:
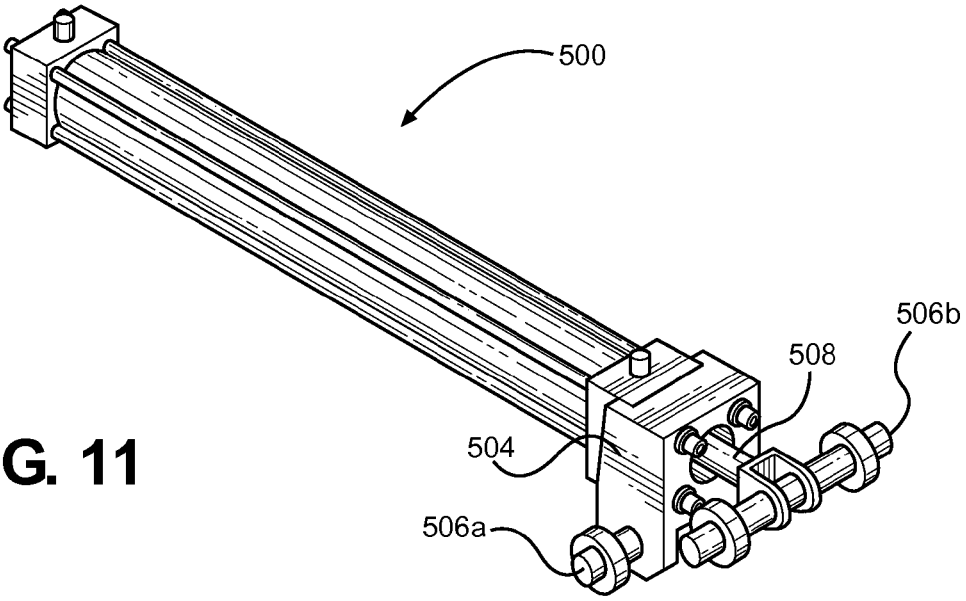
FIG. 11 shows an example hydraulic ram of the applicator bar.
Figure 12:
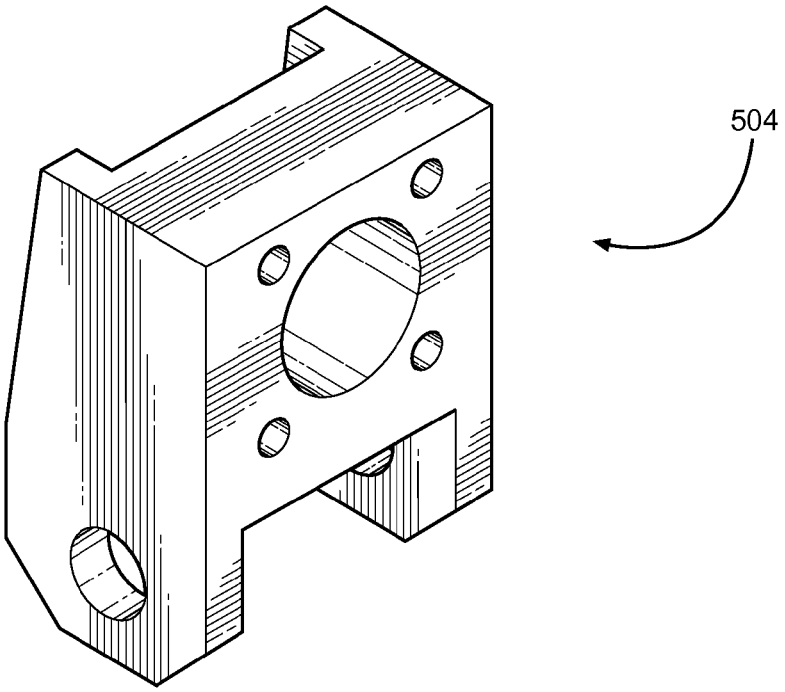
FIG. 12 shows an example ram lug of the applicator.

As shown in FIGS. 9 and 10, the applicator bar 10 includes a drive ram 500. The drive ram 500 includes a ram cylinder 502 (FIG. 11) attached to an arm 20 via a ram lug 504 (FIG. 12). A pin 506*a* is passed through holes in an arm and the ram lug 504 to secure the ram cylinder 502 to the arm 20. The drive ram 500 also includes a shaft 508 that moves in and out of the ram cylinder 502 and is attached to the other arm 20 via a pin 506*b* that is passed through a receiving portion in the shaft 508 and the arm 20. Upon actuation of the drive ram 500, the shaft 508 is moved relative to the ram cylinder 502, due to the attachment of the ram lug 504 and the shaft to different arms 20, to increase or decrease the stroke of the ram drive 500 causing the arms 20 to pivot about the hinge pin 30 and thereby changing an angle between the arms 20.

In an embodiment, the relative angle between the arms 20 is adjusted by controlling the drive ram 500. For example, the drive ram 500 may be actuated be operatively connected to the manifold 110 via a valve separate from a valve controlling rams 130. Separate sources of providing a drive fluid to the drive ram are also contemplated by the present invention.

In the embodiment, the side walls 50 of the arms 20 are maintained in respective parallel position relative to one another by one or more stiffeners 70, 80 configured to maintain a spacing and alignment of the side walls 50. In an example embodiment, one or more mid-stiffeners 70 may be placed between overlapping portion of the arms 20 and respective distal ends of the arms 20. End stiffeners 80 may be placed at respective distal ends of the arms 20. In an embodiment, the spacers may have a substantially "U-shape" and be placed on exterior side surfaces of the walls 50. By maintaining a proper spacing and alignment of the side walls 50, arm strength and rigidity is improved and an area is provided in which additional components of the applicator bar may be placed. These components and their functions will be discussed in detail below.

In an embodiment, the end stiffener 80 may include a roller 90 which, when the applicator bar is in use is in contact with the shell plate. The rollers 90 allow the applicator bar 10 to roll along the surface of the shell plate 12 thereby conforming to the angle of the shell plate as the shell plate is formed to the curvature of a respective hull frame member 14 (discussed in more detail below).

An end plate 100 may be placed at respective distal ends of the arms 20 connecting the side walls 50. As discussed in more detail below, end plates 100 may be used as an attachment or anchor point to secure the applicator bar 10 to an attachment point on a construction jig 300 (or other fixed anchoring point). In an example embodiment, chains 310 and chain hoists 320, cables, etc., may be attached to the end plates 100 and the construction jig 300 to secure the applicator bar 10 in place. In an example embodiment, the end plates 100 may include a notched portion at which a chain hook or other attachment device may be attached to the end plates 100.

The applicator bar 10 may also include a manifold 110 operatively connected to a pump 120. A plurality of rams 130 are fixed to the arms 20 and operatively connected to the manifold 110. In an example embodiment, the rams may be hydraulically or pneumatically operable. In operation, the pump 120 delivers a fluid to the rams 130 via the manifold 130 such that the rams contact the shell plate and form the shell plate to the hull frame member by pressure. In an example embodiment, the pump 120 and manifold 110 may be placed within the space between the side walls 50 of the arms or attached to an outer surface of the sidewall 50 as shown in FIGS. 9 and 10. However, the example embodiment shown in FIGS. 9 and 10 is not limited to such a configuration. For example, the pump and/or manifold could be remote from the applicator bar 10 and still be operatively connected to the rams 130.

In operation, the applicator bar 10 applies a force perpendicular to the plane of the shell plates 12 and outboard edge of the structural transverse frame members 14 inboard of the shell plate 12. The applicator bar 10 includes a hinged joint 30 at the centerline C to allow the plane of the applicator bar 10 to be parallel to the changing plane of the hull form at each transverse frame member 14. The applicator bar 10 also applies a force in multiple locations via the rams 130 along hull frame member to "walk" the plate 12 into the proper shape (typically started from the centerline of the hull working outboard to the chine) conforming to the respective hull frame member 14. The force applied perpendicular to the hull shape, is regulated via the pump 120 and manifold 110 so as to not overload and damage the structural hull framing inboard of the shell plate. Limit switches (not shown) may also be used to control a force applied to the hull.

Figure 13:
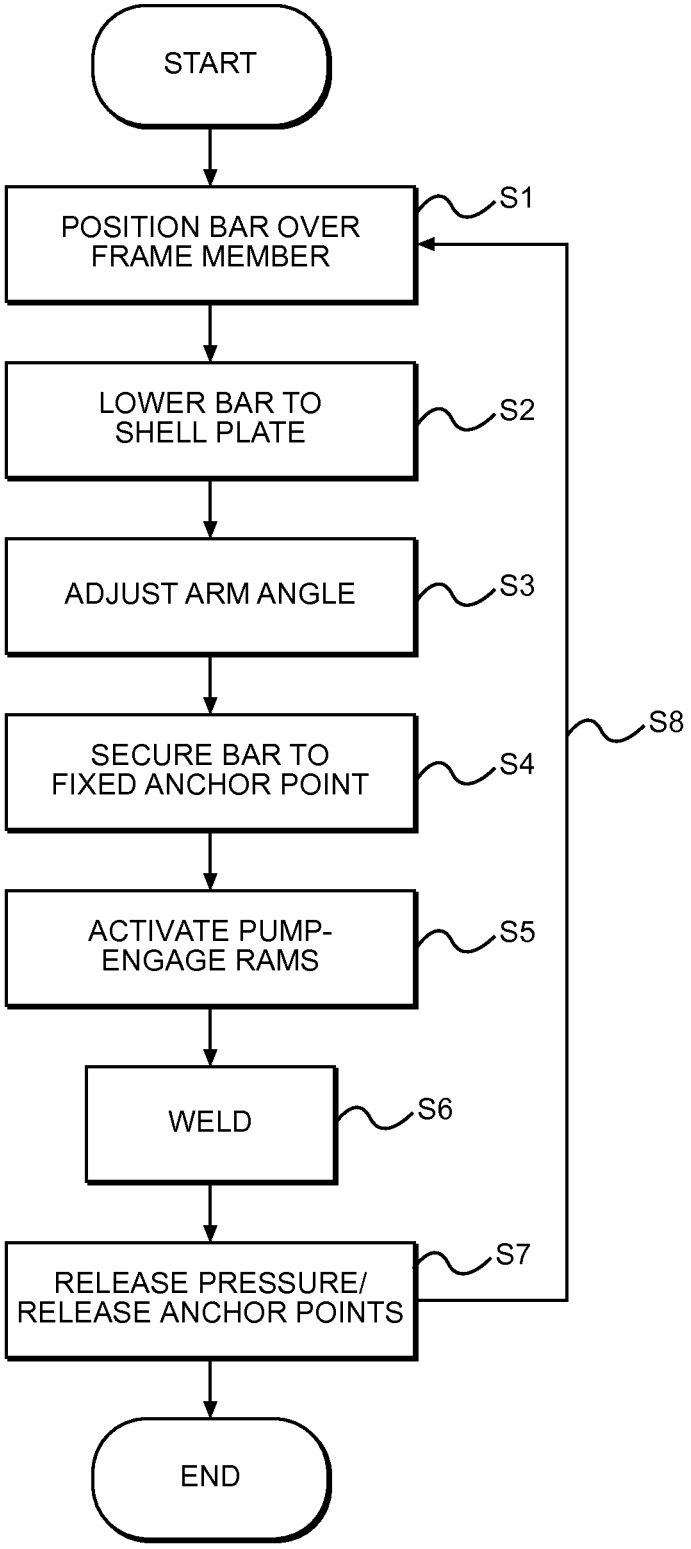
FIG. 13 is a flowchart representing an example process of using the applicator bar.

An example process of forming a shell plate 12 to a hull frame member 14 is shown in FIG. 13. The process starts and proceeds to step S1 where the applicator bar 10 is connected to an overhead crane 200 (or other lifting device) via the lifting lug 40 and positioned over a selected transverse frame member (rib) 14. At step S2, the applicator bar 10 is lowered to the shell plate 12 until the rollers 90 on respective arms 20 make contact with the shell plate 12. At step S3, the angle of the arms is adjusted (opened or closed) relative to one another to match a desired angle. For example, the angle of the arms 20 may be adjusted to closely match an angle of a shell plate 12 resting on one or more frame members 14.

In an embodiment, adjusting the arm angle may include removing the locking pin 60 and lifting the applicator bar 10 via the overhead crane 200 whereby the arms 20 will rotate about the hinge pin 30 until the holes 62 of the port and starboard arms 20 align at the appropriate/desired set of holes and the position locking pin 60 is then replaced to secure the arms at an angle concomitant with the elected position of the position locking pin 60. Adjustment of the arm angle at step S3 may also include actuating one of a screw drive 400 or a hydraulic drive ram 500 to adjust an angle between the arms as discussed above.

Once the desired arm angle is achieved, the process continues at step S4 where outboard (distal) ends of the arms 20 of the applicator bar 10 are secured to an attachment point on the construction jig 300, or other secure or fixed anchoring point, using chains 310 and chain hoists 320, for example. Once the applicator bar 10 is properly secured in position, the pump 120 is activated to deliver a fluid to the rams 130 via the manifold 130 such that ram cylinders 130 on each arm 20 are activated to engage with, and apply a force perpendicular to, each shell plate 12 individually or simultaneously at step S5 thereby pushing each shell plate 12 tightly against the hull frame member 14. At step S6, the frame member 14 and shell plate 12 are then secured together such as by tack welding, for example. At step S7, the pressure on the ram cylinders 130 is released, and the chains 310 attached to the construction jig 300 are unhooked from the applicator bar 10. The process proceeds to step S8 where the applicator bar 10 is then repositioned using the overhead crane 200 over another transverse frame member 14 and the process is repeated until each hull frame member 14 has been tack welded to the shell plate 12 whereby the process ends.

Although the above descriptions and embodiments refer primarily to forming aluminum, it is understood that the claimed applicator bar and process may be used with other materials.

The above detailed description describes example embodiments of the present invention. Persons skilled in the art will recognize that alternative embodiments are possible without departing from the scope and spirit of the present invention. The above detailed description describes different embodiments of the present invention. For example, the example embodiments of the applicator bar discussed may be made of a variety of materials and in a variety of shapes and configurations without departing from the scope and intent of this invention.

What is claimed is:

1. An applicator bar for applying a structural plate to a boat member, comprising:

a pair of angularly adjustable arms attached at a pivot point;

an angle adjusting mechanism to adjust an angle between the arms;

an anchoring member on distal ends of each of the arms to secure the applicator bar in a fixed position relative to the boat member;

a plurality of extendable pressing members attached along a length of the arms to engage the structural plate; and a roller at each distal end of the arms.

2. The applicator bar of claim 1, further comprising:

a locking pin; and a plurality of respective aligning holes in adjacent ends of each arm, wherein the locking pin is insertable into and removable from the plurality of respective aligning holes to adjust an angle formed between the arms.

3. The applicator bar of claim 1, further comprising:

a screw drive including:

a first lug secured to a first arm;

a second lug secured to a second arm;

a drive motor connected to the first lug; and a threaded rod extending between the drive motor and the second lug, wherein the rod is operatively connected to the drive motor and is threaded into the second lug to rotate the arms about the pivot point.

4. The applicator bar of claim 1, further comprising:

a drive ram connected to each of the arms, the drive ram including:

a ram cylinder attached to a first arm via a ram lug;

a shaft that moves in and out of the ram cylinder and is attached to a second arm.

5. The applicator bar of claim 1, wherein the plurality of extendable pressing members are operatively connected to a pump to extend the pressing members.

6. The applicator bar of claim 1, wherein the plurality of extendable pressing members are hydraulic ram cylinders attached along a length of each of the arms to engage the structural plate.

7. The applicator bar of claim 1, further comprising a lifting member extending from an uppermost point of the applicator bar.

8. An applicator bar for applying a structural plate to a boat member, comprising:

a pair of angularly adjustable arms attached at a pivot point;

an angle adjusting and locking mechanism connected between the pair of arms that adustably locks an angle between the arms;

an anchoring member on distal ends of each of the arms to secure the applicator bar in a fixed position relative to the boat member; and a plurality of extendable pressing members attached along a length of the arms to engage the structural plate.

9. The applicator bar of claim 8, wherein the angle adjusting and locking member includes a locking pin; and a plurality of respective aligning holes in adjacent ends of each arm, wherein the locking pin is insertable into and removable from the plurality of respective aligning holes to adjust an angle formed between the arms.

10. The applicator bar of claim 8, wherein the angle adjusting and locking member includes a screw drive having:

a first lug secured to a first arm;

a second lug secured to a second arm;

a drive motor connected to the first lug; and a threaded rod extending between the drive motor and the second lug, wherein the rod is operatively connected to the drive motor and is threaded into the second lug to rotate the arms about the pivot point.

11. The applicator bar of claim 1, wherein the angle adjusting and locking member includes a drive ram connected to each of the arms, the drive ram including:

a ram cylinder attached to a first arm via a ram lug;

a shaft that moves in and out of the ram cylinder and is attached to a second arm.

* * * * *